United States Patent [19]

Thimons et al.

[11] 4,009,649

[45] Mar. 1, 1977

[54] MINE VENTILATION CONTROL DEVICE

[75] Inventors: Edward D. Thimons, Tarentum; Fred N. Kissell, Pittsburgh, both of Pa.

[73] Assignee: The United States of America as represented by the Secretary of the Interior, Washington, D.C.

[22] Filed: Apr. 2, 1976

[21] Appl. No.: 672,901

[52] U.S. Cl. ..... 98/50; 61/45 R; 277/DIG. 10; 299/12; 299/19

[51] Int. Cl.[2] ..... E21F 17/00; E21F 1/14

[58] Field of Search ..... 98/50; 244/151 A, 151 B; 277/DIG. 10; 299/12, 19; 61/45 R, 45 F; 52/2, 83, 98, 99, 100; 137/68 R, 71; 169/64

[56] References Cited

UNITED STATES PATENTS

| | | | |
|---|---|---|---|
| 2,947,239 | 8/1960 | Burgess | 98/50 |
| 3,006,267 | 10/1961 | Hangis | 98/50 |
| 3,636,850 | 1/1972 | Burgess, Jr. | 98/50 |
| 3,863,554 | 2/1975 | Boyd | 98/50 |
| 3,948,057 | 4/1976 | Hill | 98/50 |
| 3,977,312 | 8/1976 | Kissell | 98/50 |

*Primary Examiner*—Ronald C. Capossela
*Attorney, Agent, or Firm*—Gersten Sadowsky; Donald R. Fraser

[57] ABSTRACT

The invention relates to a mine stopping for underground mines which may be readily mounted within a mine airway to form a gas-tight seal to control the flow of fresh air to the working face of the mine and the efficient exhaust of dirty gas laden air from the working face. The stopping is typically formed of a flexible, gas impervious, fire resistant sheet material provided with means for mounting the same within the interior of the mine. The mounting means embody inherent characteristics of permitting the main body of sheet material to separate from the mine interior walls upon the occurrence of a certain predetermined pressure difference between the opposing major surfaces of the main body of the stopping as may occur by a blasting or underground explosion. Thereby the main body portion of the stopping is not damaged and may be reused.

7 Claims, 3 Drawing Figures

MINE VENTILATION CONTROL DEVICE

PRIOR ART

Brattice cloth, wood, and plastic sheet materials presently employed in the fabrication of stoppings for underground mines have a substantial amount of their peripheral marginal edge portions securely affixed by fastening means to the roof, side walls, and in some instances, the floors of the mine passages. When blasting conditions or explosions occur, the marginal edges of these stoppings are so securely fastened that the main body portions thereof are damaged necessitating substantial repair work to replace or restore them. Exemplary of the prior art system using flexible, fire-resistant, gas impervious flexible material is the mine ventilation system illustrated and described in U.S. Pat. No. 3,863,554. This patent discloses a system for effectively ventilating an underground mine by providing air-tight seals around the perimeters of the sheeting material to militate against leakage due to the pressure differential. But during blasting or an explosion, the main body portion of the sheet may rupture or tear, thereby permanently damaging the sheet.

OBJECTIVES OF THE INVENTION

It is an objective of the present invention to produce a mine ventilation stopping for underground mines which may be readily and easily installed and separate, without damage, from the interior wall surfaces of the mine upon the occurrence of a greater than normal pressure differential across the face thereof.

Another object of the invention is to produce a mine ventilation stopping which is formed of a gas impervious, flexible sheeting material sewn into a generally hemispherical or bowl-like shape wherein the marginal edge portions are caused to be formed into intimate contact with the interior mine walls by the pressure caused by the means for delivering or exhausting air from the mine, such as a mine fan.

Still another object of the invention is to produce a stopping structure for an underground mine which will readily accommodate to irregularity in the mine wall surfaces to form an air-tight seal.

A further object of the invention is to produce a stopping for an underground mine which may be readily, easily, and economically installed and reinstalled.

SUMMARY OF THE INVENTION

The above, as well as other objectives of the invention, may be effectively achieved by a mine ventilation control system for underground mines having passageways which must be blocked to form suitable air passageways which includes a stopping for blocking a passageway having roof, side walls, and floor surfaces wherein the stopping is hemispherical or bowl-shaped and formed of a gas impervious, fire-resistant, flexible sheeting material adapted to extend in gas-tight relation between the roof, side walls, and floor surfaces of the passageway, and frangible means for securing the stopping in the passageway, the frangible means capable of breaking away by a force less than the force necessary to damage the sheeting material of the stopping.

IN THE DRAWINGS

The objectives and advantages of the invention will be readily understood by reading the following detailed description of an embodiment of the invention when considered in the light of the attached drawings, in which.

DETAILED DESCRIPTION OF THE INVENTION

Figure 1:
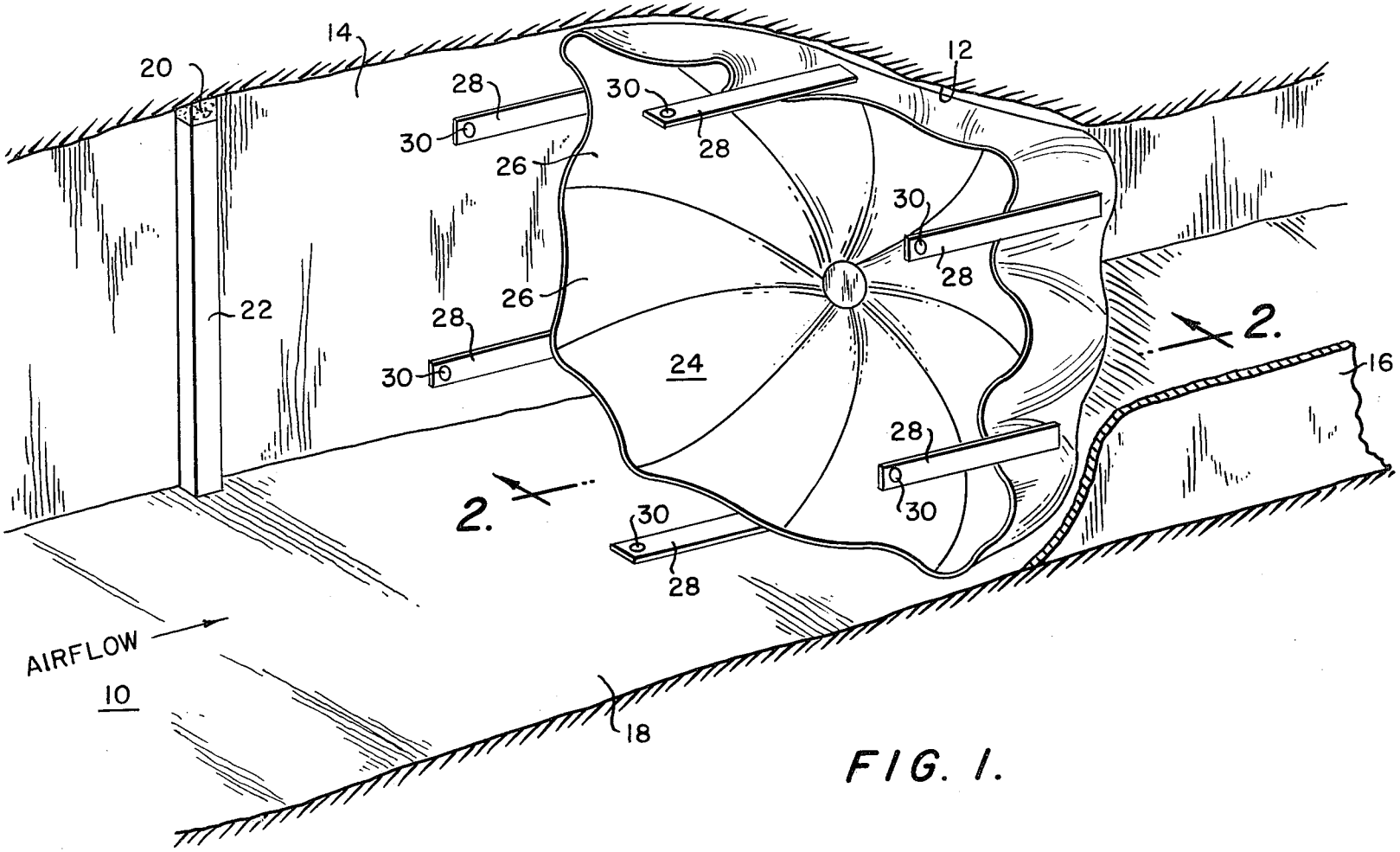
FIG. 1 is a cut-away perspective view of a mine passageway having a stopping construction in accordance with the teachings of the invention.
Figure 2:
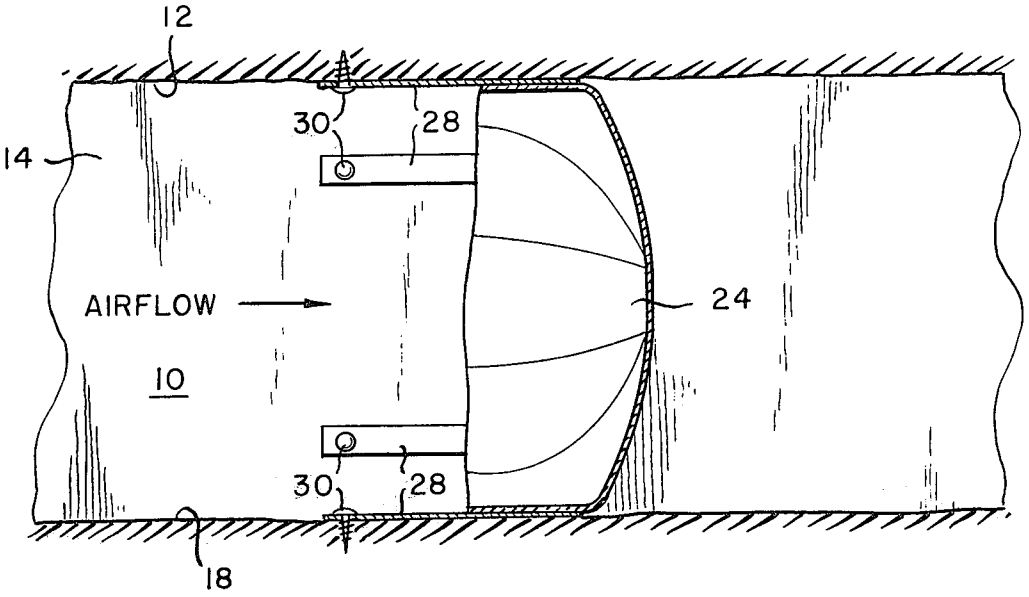
FIG. 2 is a sectional view of the invention illustrated in FIG. 1 taken along line 2—2 thereof.

In mine ventilation control systems for underground mines, fresh air is delivered under pressure to the working face of the mine at a velocity sufficient to remove dust and gases. In the event the incoming air is not delivered at the desired velocity, the dust and gases at the working face will not be effectively dispersed and conducted to the atmosphere outside of the mine through suitably dispersed return air passageways, thereby creating a hazardous condition for the miners. As the distance between the mine opening and the working face of the mine is oftentimes several thousand feet, there is a great pressure differential between established intake and the return air flow passages. If the stoppings which define the intake and return air passageways do not adequately produce a gas-tight seal with the interior walls, roof, and the floor of the mine, pressure losses will occur along the passageways which cumulatively will cause or result in a reduced velocity of the ventilating air stream at the working face. Accordingly, it is of paramount importance that the stoppings are effective to form a gas-tight seal at each separate location.

Stoppings of the prior art were typically formed of cinder block and cement employing various schemes to effect a seal at the perimeter thereof. Manifestly, such structures are time consuming and costly to erect and later remove, if necessary. More recently, such stoppings have been fabricated from chloride sheeting manufactured with a scrim-cloth reinforcing materials of fibers of glass. Such material is extremely tough, abrasion resistant, and easily installed and removed to new locations. While these stoppings have exhibited excellent ventilating properties, the tensile strength is typically not sufficient to withstand the sharp and relatively high pressure differentials imposed thereon by underground blasting or explosion conditions. Upon the occurrence of such conditions, the sheeting materials have ripped apart and are costly to repair, and in many instances, must be discarded.

As will become readily apparent to those skilled in the art from the following detailed description, the invention has produced a stopping of a configuration which will inherently form a gas tight relation with the adjacent interior surfaces of the mines and also effectively break-away or release upon the occurrence of a high pressure differential across the opening surfaces thereof without any major damage to the sheeting material. Thereby, the stopping material may be reused, thus resulting in a major cost saving to the mine operator. Cost saving is also achieved as a result of reduced labor in reinstalling the stopping.

With reference to the drawings, there is illustrated a mine passageway 10 having typical roof 12, side walls 14 and 16, and floor 18. Horizontally disposed roof supports or timbers 20 are maintained in roof supporting relation to the mine roof 12 by suitable vertically disposed support timbers 22, for example.

The mine passageway 10 is blocked by a stopping, generally designated by reference numeral 24. The stopping 24 is comprised of a plurality of panels 26 sewn together to form a unitary structure in the shape of a hemisphere or bowl. The panels 26 are typically formed of a flexible, gas impervious, fire resistant sheeting material such as a nylon fabric having a mylar sheet adhered thereto for example, stitched or otherwise suitably fastened to the adjacent panels at their joining marginal edges. The stopping 24 is large enough to fill the mine passageway 10 in which it is intended for use. Its perimeter is at least equal to or is greater than the perimeter of the passageway.

Spaced equidistantly around the perimeter of the bowl-shaped stopping 24 are strap members 28. The strap members 28 may be composed of a material such as canvas, for example, which has less tensile strength than the material of the panels 26.

The stopping 24 is utilized within the mine passageway 10 by attaching each of the strap members 28 to the mine roof 12, side walls 14, and floor 18 by fasteners 30 driven into the adjacent mine surface by means of a spad gun or powder actuated pins. The stopping, although it could be employed as an air barrier almost anywhere in a mine, is readily intended to be used near the working face of a mine where blast damage to stoppings can occur.

In use, the air pressure that develops across the stopping 24 will effectively force the marginal perimetal edges against the mine roof 12, side walls 14, and floor 18, to establish an air tight seal across the mine passageway 10. Manifestly, the air sealing feature inherent in the structure results in an efficient stopping and a system which can be installed with a minimum of effort and expenditure of time and personnel. Due to the fact the shape of the stopping 24 naturally forms a good and effective seal with the mine airway 10, the number of necessary attachment strap members 28 is substantially less than would be required for conventional brattice cloth stoppings, for example.

When blasting occurs in the mine in the vicinity of the stopping 24, the relatively short strap members 28, which, as explained hereinabove, are of lesser strength than the material of the panels 26, will tear away from the fasteners 30, and the stopping 24 will blow down and collapse. The stopping 24, except for the strap members 28, is not damaged and can be readily reerected in a matter of minutes by attaching another of the straps located at each strap location on the stopping to the interior surfaces of the mine. In many instances, the old strap members 28 may be reused, if not too badly damaged.

Accordingly, it will be apparent to those skilled in the art that the ballooned out or bowl-shaped configuration of the stopping 24 provides extra strength characteristics to withstand the explosion forces mentioned above and reduces the stresses imposed thereon as compared to the structures of the prior art.

Figure 3:
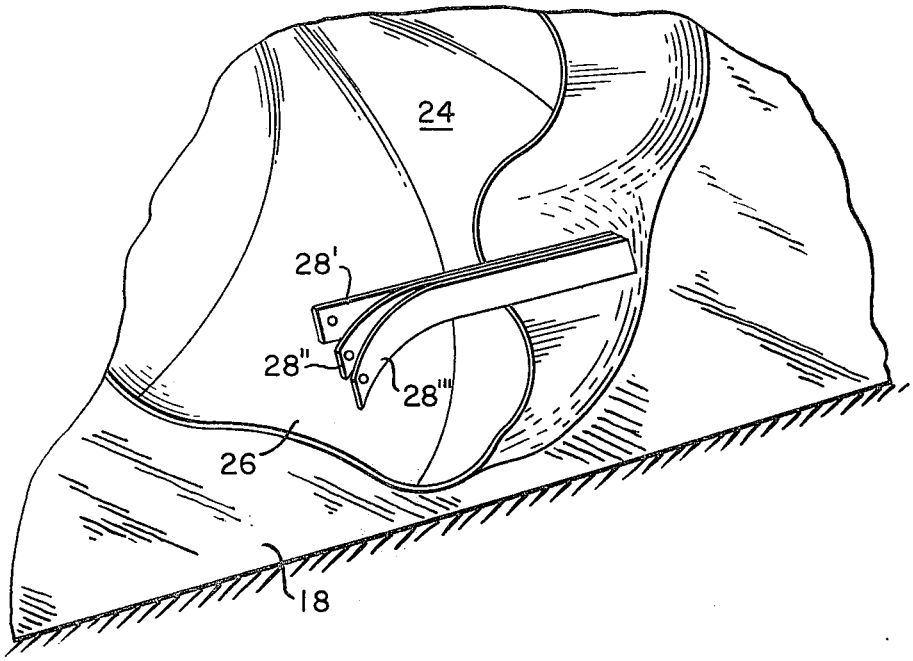
FIG. 3 is an enlarged fragmentary perspective view of a modified form of the invention illustrated in FIGS. 1 and 2.

Several straps $28^{1}$, $28^{11}$, and $28^{111}$ may be attached at each location, as illustrated in FIG. 3. The modification of the invention illustrated in FIG. 3 shows form of the invention wherein the individual strap members utilize a manifold arrangement of superimposed straps $28^{1}$, $28^{11}$, and $28^{111}$. Manifestly, in use, only a single one of the straps at each location is to be fastened to the interior surface of the mine at one time. Accordingly, in the event blasting occurs and the stopping 24 is caused to tear away, the assembly may be readily reinstalled by utilized one of the remaining strap members at each location.

We claim:

1. In a mine ventilation control system for underground mines having passageways which must be blocked to form suitable air passageways including:

a stopping for blocking a passageway by forming a seal between the roof, side walls, and floor surfaces thereof, and formed of a gas impervious, fire-resistant, flexible sheeting material adapted to extend in gas-tight relation between the roof, side walls, and floor surfaces of the mine passageway, and frangible means for securing said stopping in the passageway, said frangible means capable of breaking away by a force less than the force necessary to damage the flexible sheeting material of said stopping.

2. The invention defined in claim 1 wherein said stopping is bowl-shaped.

3. The invention defined in claim 2 wherein said stopping is formed of a plurality of shaped sections having their adjacent marginal edges secured together.

4. The invention defined in claim 1 wherein said sheeting material is mylar-coated nylon fabric.

5. The invention defined in claim 1 wherein said frangible means are straps.

6. The invention defined in claim 5 wherein said straps are formed of a woven material.

7. The invention defined in claim 6 wherein said woven material is canvas.

* * * * *